US011311430B2

(12) United States Patent
Calkin

(10) Patent No.: US 11,311,430 B2
(45) Date of Patent: Apr. 26, 2022

(54) RESCUE STRETCHER WITH INTEGRATED HARNESS

(71) Applicant: SKEDCO, INC., Tualatin, OR (US)

(72) Inventor: Carston R. Calkin, Tualatin, OR (US)

(73) Assignee: SKEDCO, INC., Tualatin, OR (US)

( * ) Notice: Subject to any disclaimer, the term of this patent is extended or adjusted under 35 U.S.C. 154(b) by 68 days.

(21) Appl. No.: 16/634,554

(22) PCT Filed: Feb. 22, 2019

(86) PCT No.: PCT/US2019/019284

§ 371 (c)(1),
(2) Date: Jan. 27, 2020

(87) PCT Pub. No.: WO2019/165301

PCT Pub. Date: Aug. 29, 2019

(65) Prior Publication Data

US 2021/0106473 A1 Apr. 15, 2021

Related U.S. Application Data

(60) Provisional application No. 62/634,657, filed on Feb. 23, 2018.

(51) Int. Cl.
*A61G 1/044* (2006.01)
*B63C 9/135* (2006.01)

(52) U.S. Cl.
CPC ..... *A61G 1/044* (2013.01); *B63C 9/135* (2013.01)

(58) Field of Classification Search
None
See application file for complete search history.

(56) References Cited

U.S. PATENT DOCUMENTS 1,270,107 A 6/1918 Boardman
2,361,789 A 10/1944 Nicholas
(Continued)

FOREIGN PATENT DOCUMENTS

EP 3162347 A1 * 5/2017 ..... A61G 7/1051
WO 2005039475 A1 5/2005
WO WO-2008097873 A1 * 8/2008 ..... A61G 1/01

OTHER PUBLICATIONS

ARC Products, Med-Sled Vertical Lift Rescue, 2009, 2 pgs.
(Continued)

*Primary Examiner* — David R Hare
*Assistant Examiner* — Adam C Ortiz
(74) *Attorney, Agent, or Firm* — Stoel Rives LLP

(57) ABSTRACT

A stretcher including a flexible base panel sized to support a person lying thereon during a rescue or extrication operation. The base panel includes a header end and an opposite footer end, and further includes a support mat resting on the base panel between the header and footer ends. The stretcher further include a shoulder harness with a pair of shoulder straps and a groin harness with leg straps fixedly coupled to the support mat for securing the person to the base panel. A securement strap may be coupled to the base panel and extend across the flexible base panel to help prevent the injured person from rolling off the sides of the stretcher. The rescue stretcher may further include one or more flotation devices attached thereto to facilitate water evacuations.

20 Claims, 13 Drawing Sheets

(56) References Cited

U.S. PATENT DOCUMENTS

| | | | | |
|---|---|---|---|---|
| 2,366,082 | A | 12/1944 | Baker | |
| 2,519,376 | A * | 8/1950 | Jennings | B63B 7/082 441/80 |
| 2,788,530 | A | 4/1957 | Ferguson | |
| 2,899,692 | A | 8/1959 | Finken | |
| 2,935,751 | A | 5/1960 | Emmick et al. | |
| 3,046,982 | A | 7/1962 | Davis | |
| 3,158,875 | A | 12/1964 | Fletcher | |
| 3,287,895 | A | 11/1966 | Hire | |
| 3,707,734 | A | 1/1973 | Matthews | |
| 4,127,120 | A | 11/1978 | Applegate | |
| 4,151,842 | A | 5/1979 | Miller | |
| 4,283,068 | A | 8/1981 | Keyser | |
| 4,347,635 | A | 9/1982 | Eisenhauer | |
| 4,601,075 | A | 7/1986 | Smith | |
| 5,014,374 | A | 5/1991 | Williams | |
| 5,027,833 | A | 7/1991 | Calkin | |
| 5,048,134 | A | 9/1991 | Dennill et al. | |
| 5,121,514 | A | 6/1992 | Rosane | |
| 5,211,186 | A | 5/1993 | Shoemaker et al. | |
| 5,285,797 | A | 2/1994 | Zeller | |
| 5,729,850 | A | 3/1998 | Eskeli | |
| D421,413 | S | 3/2000 | Calkin | |
| 6,227,201 | B1 | 5/2001 | Ferko, III | |
| 6,871,368 | B2 | 3/2005 | Calkin | |
| 6,966,087 | B2 | 11/2005 | Robinette | |
| 7,422,220 | B2 | 9/2008 | Walkingshaw et al. | |
| 7,810,820 | B2 | 10/2010 | Wolf et al. | |
| 8,667,629 | B2 | 3/2014 | Mohr et al. | |
| 8,677,530 | B2 | 3/2014 | Calkin | |
| D712,796 | S | 9/2014 | Calkin | |
| 9,173,789 | B2 | 11/2015 | Haskell et al. | |
| 9,827,152 | B1 | 11/2017 | Calkin | |
| 2004/0088794 | A1 | 5/2004 | Calkin | |
| 2007/0136950 | A1 | 6/2007 | Zuercher | |
| 2008/0184488 | A1 * | 8/2008 | Fee | A61G 1/01 5/628 |
| 2010/0005593 | A1 | 1/2010 | Bowling et al. | |
| 2010/0233922 | A1 | 9/2010 | Cynamon | |
| 2012/0102650 | A1 | 5/2012 | McGlynn | |
| 2015/0313778 | A1 | 11/2015 | Chia et al. | |
| 2016/0176683 | A1 | 6/2016 | Huehn | |
| 2018/0289568 | A1 * | 10/2018 | Allen | F41H 5/02 |

OTHER PUBLICATIONS

International Search Report and Written Opinion for International Application No. PCT/US2019/019284, dated Jun. 24, 2019, 11 pages.

Veasey, et al. .“Confined Space Entry and Emergency Response”, 2002, pp. 429-433, The McGraw-Hill Companies, Inc., U.S.

* cited by examiner

RESCUE STRETCHER WITH INTEGRATED HARNESS

RELATED APPLICATIONS DATA

This application is the National Stage of International Application No. PCT/US2019/019284, filed Feb. 22, 2019, which claims the benefit of U.S. Provisional Patent Application No. 62/634,657, filed Feb. 23, 2018, the disclosures of both of which are hereby incorporated by reference in their entireties.

TECHNICAL FIELD

The field of the disclosure relates generally to rescue stretchers with straps for securing an injured person to the rescue stretcher and facilitating transport of the injured person to a vehicle or suitable location for medical treatment.

BACKGROUND

Transporting an incapacitated or injured person to a hospital or other treatment facility is often an essential part of providing proper medical care. An ambulance, helicopter, or other similar vehicle is well-known for such transport. However, in some instances, such as when the injured person is in a forested area, on an embankment, or on a battlefield, transport vehicles may not be a feasible option and/or may have difficulty accessing the location of the injured person. In such cases, the injured person may be transported from the injury site to another location (e.g., a medical tent) either for treatment, or for loading onto an ambulance (or other rescue vehicle) and thereafter taken to the hospital or other treatment facility. In these situations, lightweight and easily deployable stretchers, litters, and other similar devices are generally known for facilitating such casualty movement. To help prevent further injury, these devices generally include restraints or straps to immobilize the injured person during transport.

The present inventor has recognized several disadvantages with such conventional lightweight stretchers. For example, during use of the stretcher, the straps typically extend transversely across the stretcher and are tightly cinched to restrain the person on the stretcher. One disadvantage of this configuration is that the injured person is primarily restrained via the compressive force of the tightened straps, which may complicate or exacerbate existing injuries. In addition, while transverse straps may help prevent the injured person from rolling off the sides of the rescue stretcher, such straps are not particularly well-suited for preventing the person from sliding toward the top or bottom ends of the stretcher during transport. Preventing this movement is a great concern during certain evacuation scenarios, such as air-lift rescue operations or transport on sloped terrains, where gravitational forces pull the injured person and may cause sliding off the top or bottom ends of the stretcher.

In addition, many lightweight stretchers lack sufficient support or padding for the injured person to minimize the potential of causing further injury during transport. For example, during some rescue operations, the injured person may be dragged across rough terrain (e.g., rocks, rubble, or other debris) on the lightweight stretcher. Without padding, the debris may cause discomfort and possibly further injury as the injured person is dragged through the debris. Moreover, many lightweight stretchers are not sufficiently sturdy or otherwise equipped to support air lift evacuations while firmly restraining the injured person in the rescue stretcher and protecting the person to avoid causing further injury. Finally, many lightweight stretchers are not configurable to accommodate flotation devices to help load a person that may be injured in the water, or to transport an injured person over a body of water during an evacuation procedure if necessary.

Accordingly, the present inventor has recognized a need for an improved rescue stretcher that offers a streamlined design for quick deployment, efficient patient packaging, and rapid horizontal and/or vertical hoist capabilities for expeditious evacuations. The present inventor has also recognized a need for such an improved rescue stretcher with various attachment points to facilitate air lift evacuations, and to provide protective support for the injured person during transport, including during water evacuations. Additional aspects and advantages will be apparent from the following detailed description of example embodiments, which proceeds with reference to the accompanying drawings.

DETAILED DESCRIPTION OF EXAMPLE EMBODIMENTS

Figure 1:
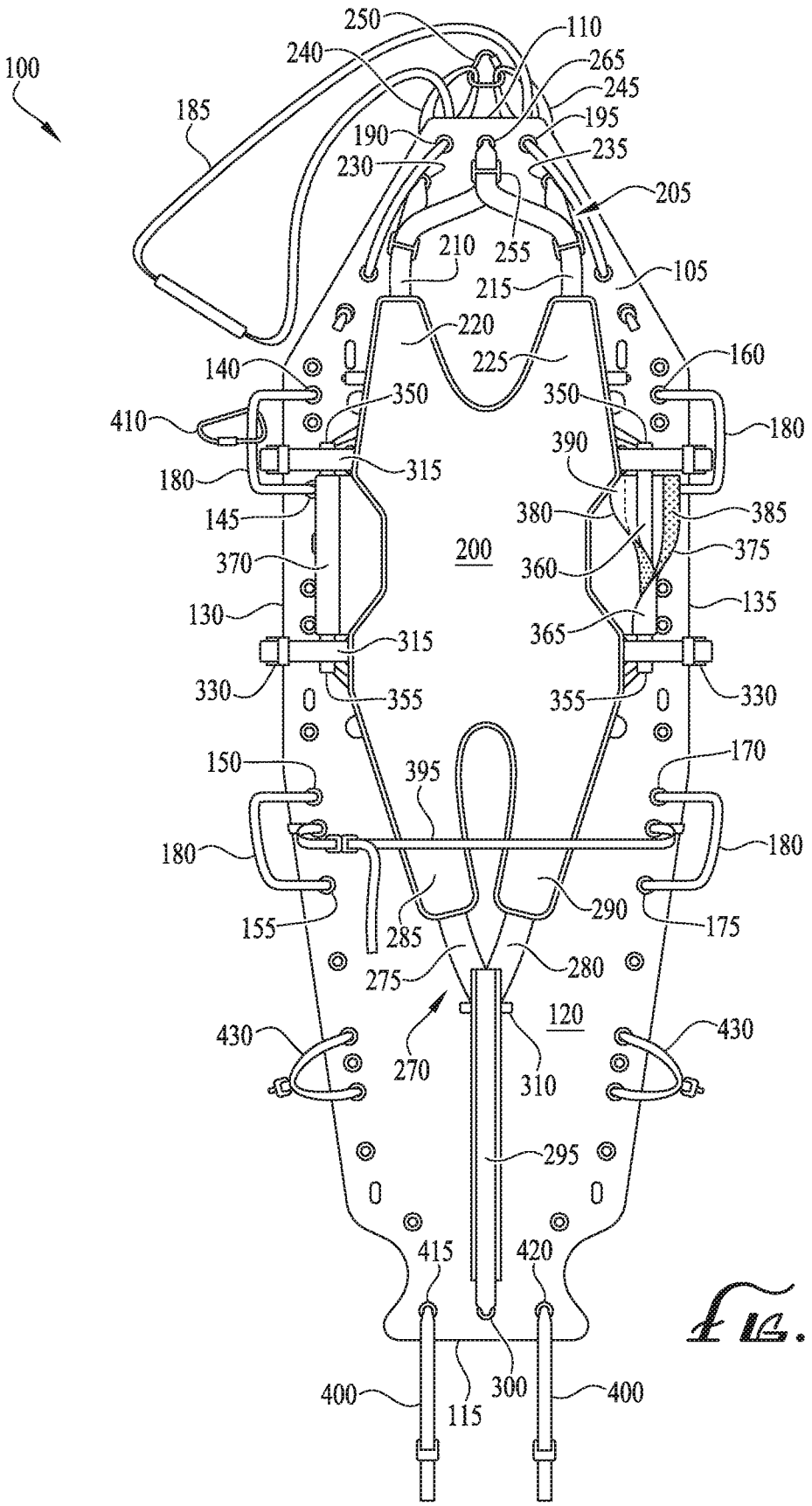
FIG. 1 is a top view of a rescue stretcher in a flat configuration in accordance with one embodiment.

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-13 collectively illustrate various details and embodiments of a rescue stretcher 100, 1100, 1200 that may be used to support and safely extract an injured person 50 from a hazardous environment. The following section proceeds with particular reference to features of the rescue stretcher 100 of FIG. 1, but it should be understood that the same features apply to other embodiments of the rescue stretcher 1100, 1200 illustrated in other figures. The rescue stretcher 100 includes an elongated, flexible base panel 105 panel having a plurality of eyelets 140, 145, 150, 155, 160, 165, 170, 175 spaced along left and right peripheral edges 130, 135, respectively of the base panel 105 (see FIG. 3). A plurality of loop handles 180 are weaved through the eyelets 140, 145, 150, 155, 160, 165, 170, 175 to couple the loop handles 180 to the base panel 105. Base panel 105 further includes a plurality of eyelets 190, 195 spaced along the header end 110 to receive a drag handle or strap 185, and eyelets 415, 420 spaced along footer end 115 of the base panel 105 through which is weaved a pair of foot end straps 400. As further described in detail below, the loop handles 180 may be used to aid evacuation personnel in carrying the injured person 50 from the hazardous environment to another location for treatment.

The rescue stretcher 100 further includes a support mat 200 coupled to the base panel 105, the support mat 200 having a sufficient thickness to support the person 50 and to help protect against debris or other hazards that may cause further injury or discomfort to the person 50, such as during a dragging extraction. In addition, the support mat 200 includes various slings and/or straps used to secure the person 50 to the base panel 105 for transport, such as for dragging extractions and air-lift rescues. As further described in detail below, the slings and straps may be fixedly coupled to the support mat 200 to facilitate efficient deployment for both horizontal and vertical hoist extractions.

Figure 6:
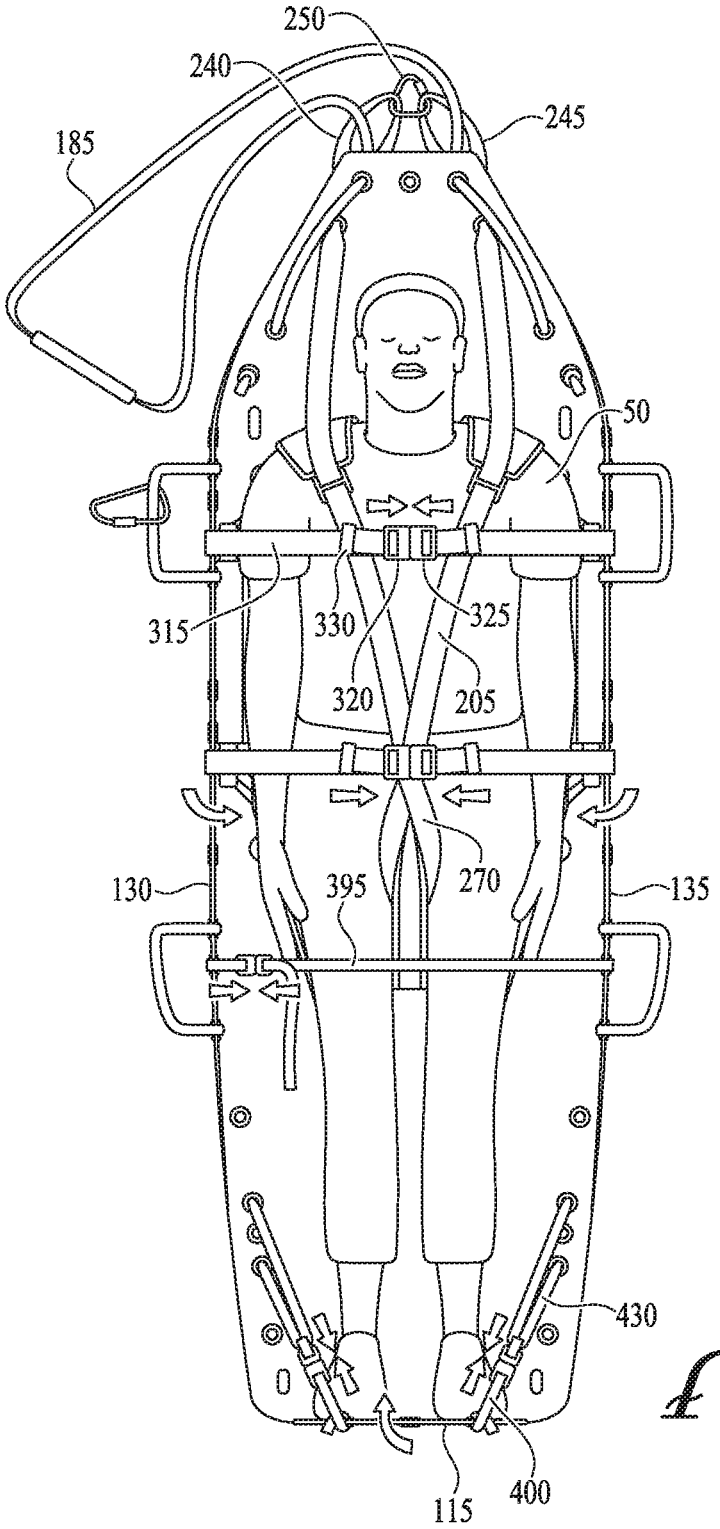
Figure 7:
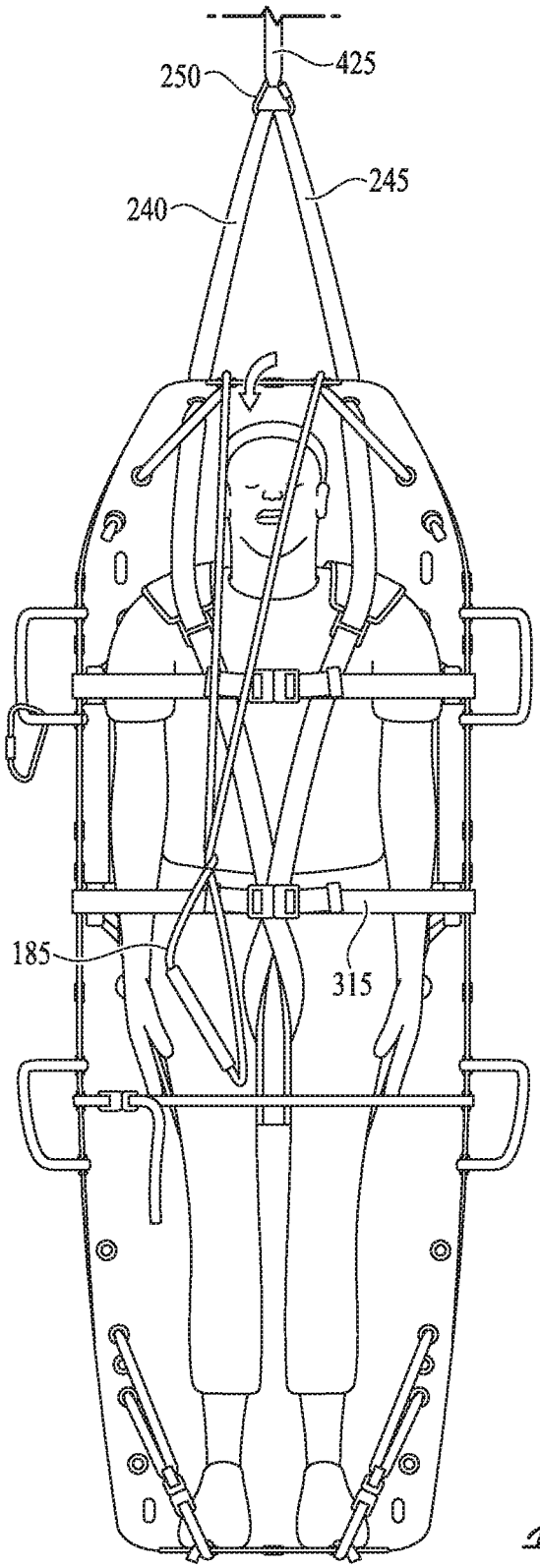
FIG. 7 illustrates a process for preparing the secured person for a vertical lift or vertical descent extraction.

In one example configuration, the securement straps 315 extend transversely across the base panel 105 and over the person 50 lying on the support mat 200. When securement straps 315 are tightened, base panel 105 rolls inwardly to at least partially cradle person 50 and help prevent person 50 from rolling off the base panel 105 (e.g., such as via left and right peripheral edges 130, 135) as illustrated in FIG. 6. The shoulder harness 205 and foot end straps 400, when secured and tightened, support the person 50 and collectively limit movement of the person 50 toward the header end 110 and the footer end 115 of rescue stretcher 100. As illustrated in FIG. 6, the shoulder harness 205 extends over the shoulders of the injured person 50 and couples to a groin harness 270 to arrest the shoulders and lower body, respectively, and help prevent the injured person 50 from slipping or moving toward either the header end 110 or the footer end 115 of base panel 105. Similarly, the foot end straps 400 extend inwardly from the peripheral edges 130, 135 respectively, toward the footer end 115 and urge the footer end 115 to roll inwardly to create a foot rest and arrest movement of the person downwardly toward the footer end 115.

The following describes further detailed aspects of this and other embodiments of rescue stretcher 100, 1100, 1200. In the following description of the figures and any example embodiments, reference may be made to using the rescue stretcher disclosed herein to support and transport injured person. It should be understood that any such references merely refer to one prospective use for such a rescue stretcher and should not be considered as limiting. Other uses for such rescue stretcher with the characteristics and features described herein are possible, including uses to transport captured animals/game, or transporting equipment, firewood, ammunition, or other heavy loads (including both military and civilian uses). Still other uses not specifically described herein may be possible.

In addition, the following disclosure may include references to an injured person's body parts and/or particular regions of the body. It should be understood that any such discussion is meant to facilitate description and establish a frame of reference relating to a typical injured person with all limbs and body parts intact. Accordingly, any such references are for convenience only and should not be considered as limiting.

Figure 2:
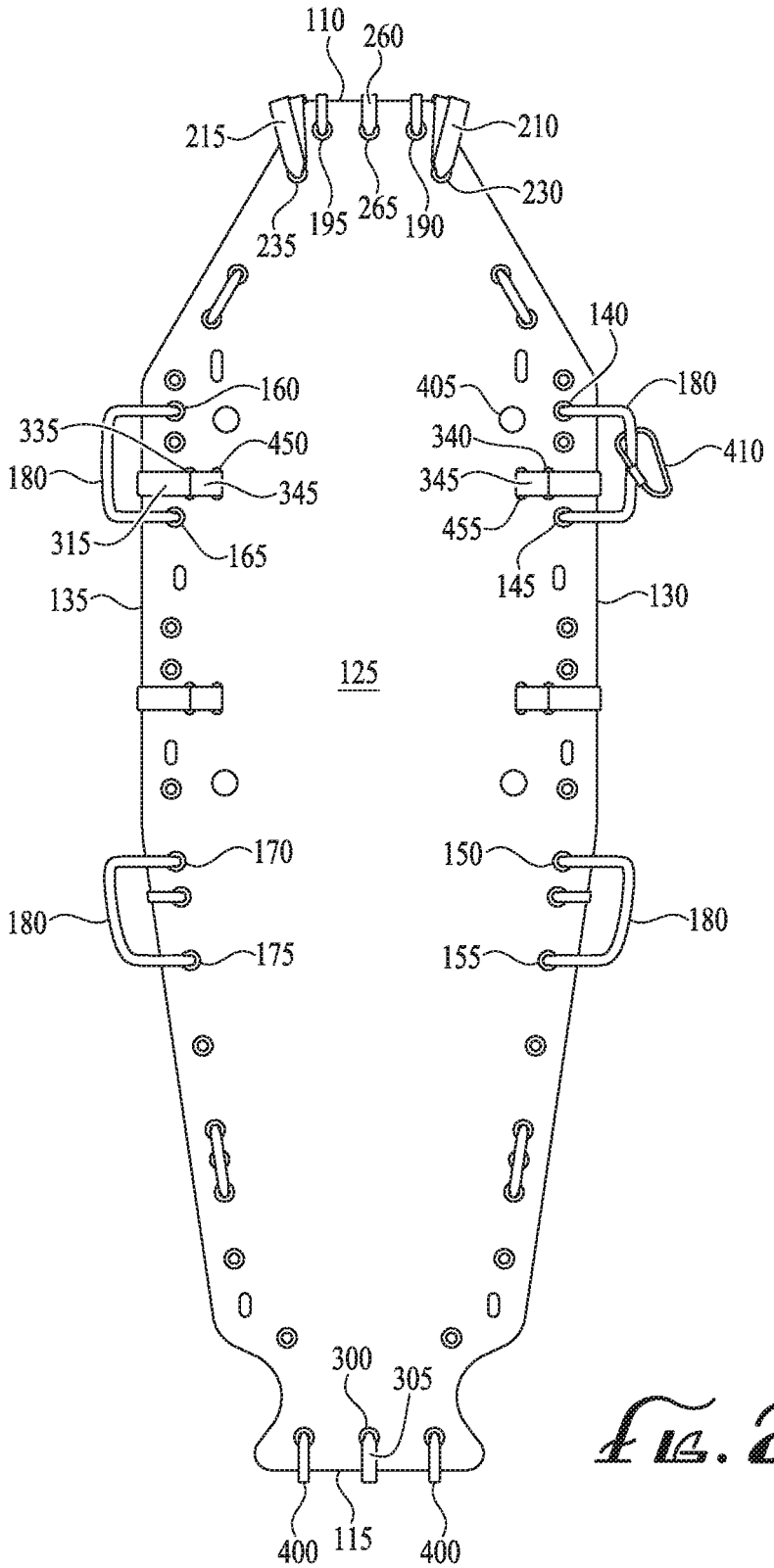
FIG. 2 is a rear view of the rescue stretcher of FIG. 1.
Figure 3:
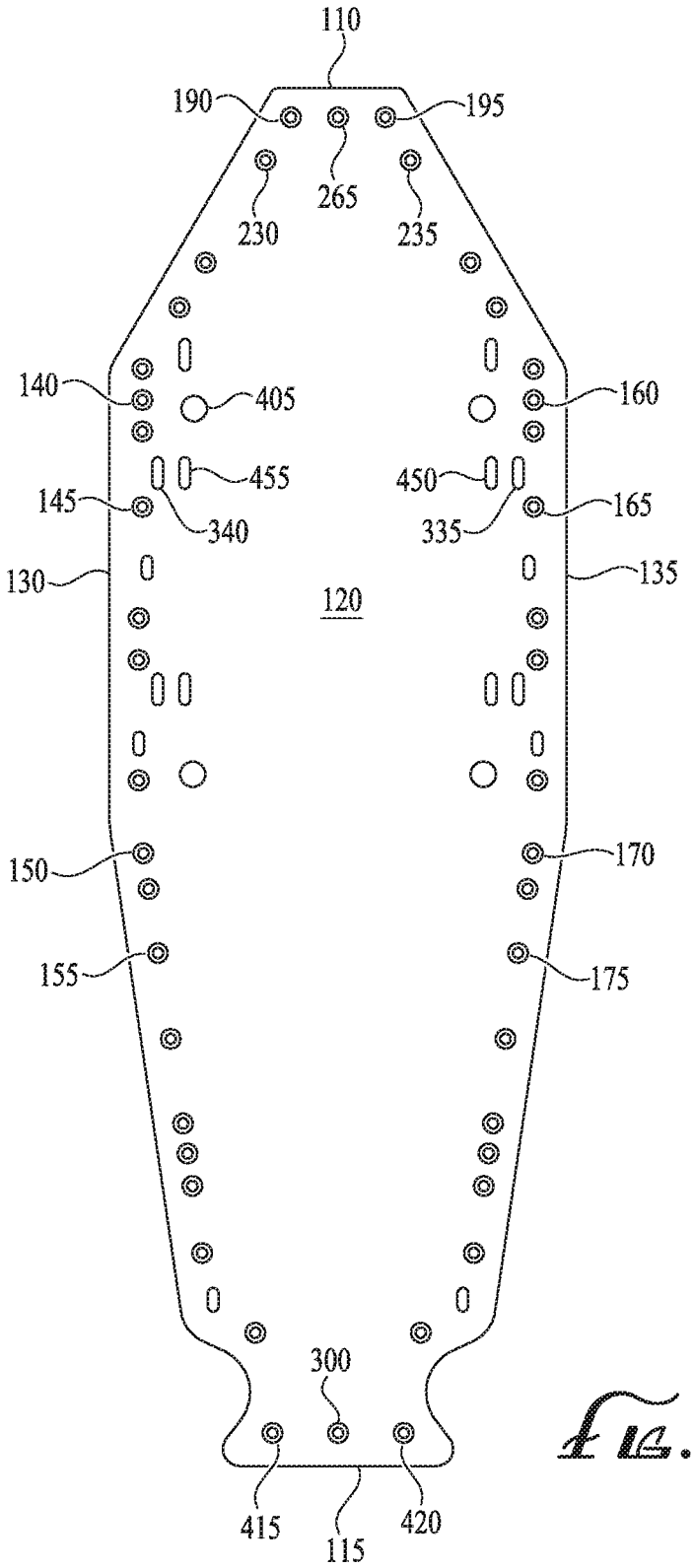
FIG. 3 is a top view of the rescue stretcher of FIG. 1 with the harness and securement straps removed illustrating features of the base panel.

FIGS. 1-2 collectively illustrate top and bottom views of a rescue stretcher 100 in a flat configuration in accordance with one embodiment, and FIG. 3 illustrates a view of the rescue stretcher 100 with the support mat 200 removed to illustrate certain components of a base panel 105 of the rescue stretcher 100. With general reference to FIGS. 1-3, the following provides a brief overview of various components of the rescue stretcher 100, with FIGS. 4-10 providing more detailed descriptions of certain aspects of the rescue stretcher 100. As illustrated in FIG. 1, rescue stretcher 100 includes an elongated base panel 105 formed of a lightweight and flexible material with strength and durability characteristics suitable for supporting the weight of an injured person 50 during transport. In one embodiment, base panel 105 comprises a single sheet of lightweight plastic material, such as medium-density polyethylene or a synthetic thermoplastic resin, selected for durability, strength, flexibility and resistance to damage (such as from cutting, scarring, denting, breaking, and deforming) to provide a suitable rescue stretcher 100 for carrying injured people. Base panel 105 includes a header end 110 and a footer end 115 opposite header end 110, and further includes opposite front and back surfaces 120, 125 and opposite left and right peripheral edges 130, 135 horizontally offset from one another. To establish a frame of reference, front surface 120 refers to a surface of base panel 105 that receives injured person 50 during use of rescue stretcher 100. Back surface 125 refers to the opposite surface of the base panel 105 that may contact the ground, such as during a dragging operation.

Overall, base panel 105 may have suitable dimensions for receiving and comfortably supporting injured person 50 laying thereon. For instance, in one example embodiment, base panel 105 may have a length (as measured from header end 110 to footer end 115) ranging from between 80-100 inches and a width (as measured from left edge 130 to right edge 135) ranging from between 24 to 30 inches. Base panel 105 may range in thickness from between 1/16 inches to about 1/4 inches. It should be understood that the particular dimensions described illustrate one example embodiment and that any suitable dimensions may be used. For instance, the length and width dimensions may be smaller for rescue stretchers targeted primarily for use with children, or may be wider and/or longer to accommodate various sizes for adult use.

Figure 4:
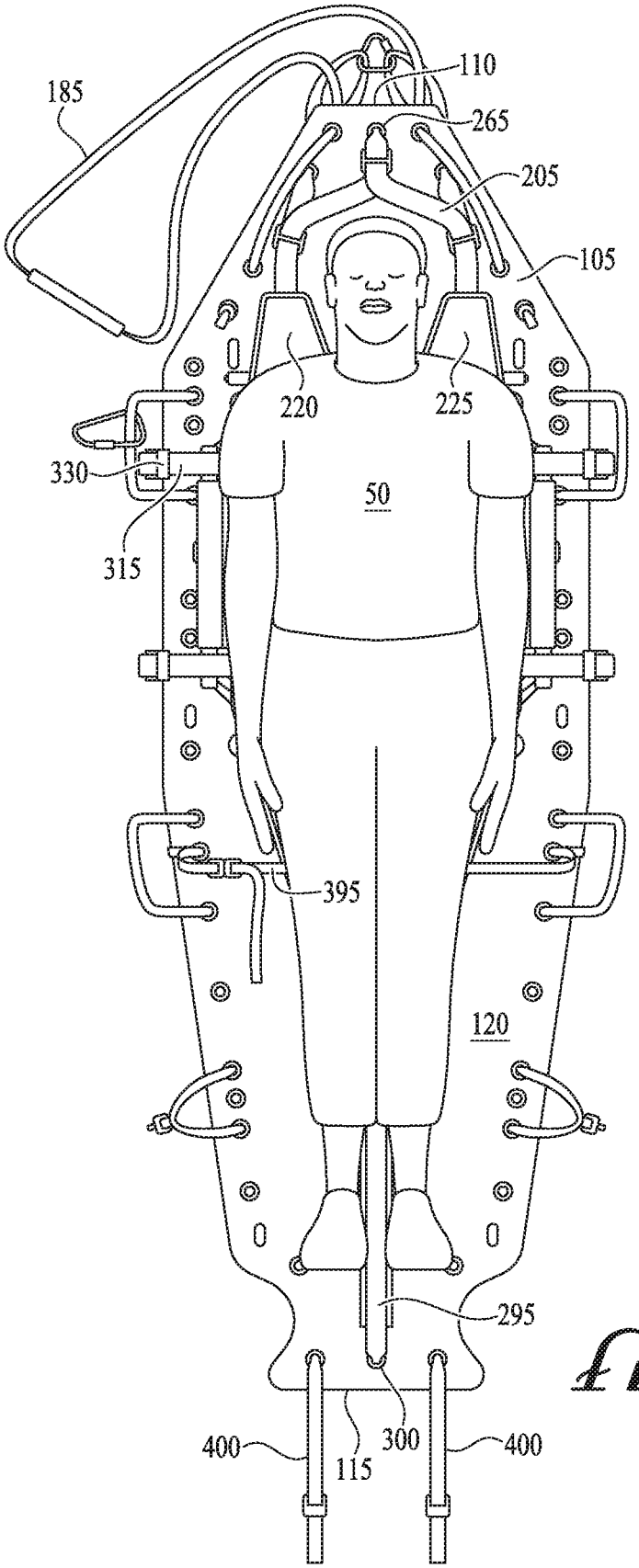
FIG. 4 is a top view illustrating an injured person laying over the harness of the rescue stretcher of FIG. 1.

As illustrated in FIG. 1, in some embodiments, base panel 105 may not have a uniform width throughout, but may include one or more tapered sections. For example, with reference to FIG. 1, left and right peripheral edges 130, 135 of base panel 105 may taper inwardly toward header end 110 from an upper portion of the base panel 105 (e.g., near the shoulder area of the person 50), and may taper inwardly toward footer end 115 from a lower portion of the base panel 105 (e.g., from the upper thigh region of the person 50) in some embodiments. In some embodiments, the left and right peripheral edges 130, 135 may uniformly and gradually taper toward header end 110 to define a generally trapezoidal upper region for supporting the head of the injured person 50. In such embodiments, base panel 105 is narrower at header end 110 as compared to a generally central body-supporting region of the base panel 105. In such a configuration, rescue stretcher 100 receives and supports the head of injured person 50 without obstructing the sides of the head of injured person 50 when rescue stretcher 100 is in an operative configuration (for example, as illustrated in FIG. 4). Similarly, left and right peripheral edges 130, 135 may gradually taper or curve inwardly toward the footer end 115 to accommodate the lower leg region of the injured person 105. In other embodiments, the base panel 105 may instead taper at different points along the left and right peripheral edges 130, 135, or may only taper along the header end 110 or along the footer end 115.

With general reference to FIG. 3, base panel 105 includes a plurality of eyelets or apertures 140, 145, 150, 155, 160, 165, 170, 175 that may drilled, cut, punched, or otherwise formed using any suitable techniques. In some embodiments, some or all of eyelets 140, 145, 150, 155, 160, 165, 170, 175 may be reinforced using conventional metal grommets (which may also be referred to as eyelets) to reduce the risk of tearing portions of base panel 105. The eyelets 140, 145, 150, 155, 160, 165, 170, 175 may each be spaced inwardly between two to four inches from the corresponding peripheral edges 130, 135 of the base panel 105. In one embodiment, eyelets 140, 145 on the peripheral edge 130 of the base panel 105 and eyelets 160, 165 on the peripheral edge 135 of the base panel 105 are arranged in a mirrored configuration such that eyelet 140 is horizontally aligned with eyelet 150, and eyelet 145 is horizontally aligned with eyelet 165. Eyelets 150, 155, 170, 175 may be arranged in a corresponding configuration.

The rescue stretcher 100 includes a plurality of loop handles 180, each loop handle 180 threaded through a corresponding pair of eyelets of base panel 105 as illustrated in FIG. 2. In such configuration, the loop handles 160 form handle pairs on either side of the base panel 105, with each loop handle 180 sufficiently spaced apart from an adjacent loop handle 180, to provide adequate spacing to allow for people to carry rescue stretcher 100 during an extraction operation. Loop handles 180 are generally sized to accommodate an adult human hand and may be formed from reinforced webbing material to provide sufficient strength for carrying the load on the base panel 105. In other embodiments, loop handles 180 may be formed from other suitable materials. Some other embodiments may include more or fewer loop handles 180 arranged in a different configuration as described herein.

In some embodiments, the rescue stretcher 100 may include a drag strap or drag handle 185 threaded through a pair of eyelets 190, 195 located along header end 110 of the base panel 105. The drag strap 185 extends upwardly beyond the header end 110 of rescue stretcher 100, and may include a looped handle to provide a grasping point for rescue personnel. In some embodiments, the drag strap 185 may be made of reinforced webbing or other suitable material with sufficient tensile strength for carrying out a dragging extraction operation of an adult person 50. In other embodiments, rescue stretcher 100 may include multiple drag straps for facilitating dragging by more than one rescuer or allowing a single rescuer to pull the person 50 with both hands. For example, instead of a looped drag strap 185, rescue stretcher 100 may include two individual straps without a looped handle, where one strap is laterally spaced apart from the other strap and each is threaded through an individual eyelet on header end 110. Other arrangements not specifically described herein may be possible.

With general reference to FIGS. 1 and 2, rescue stretcher 100 includes a support mat 200 including a top surface for receiving the injured person 50, and an opposite rear surface resting on the base panel 105. The support mat 200 has a suitable thickness to help support the person 50 and to protect against debris or other hazards that may cause further injury or discomfort to the person 50, such as during a dragging extraction. In some embodiments, the padded support mat 200 may have a thickness ranging from about 0.25 inches to about 1.0 inches. In other embodiments, the support mat 200 may have different suitable thickness as desired to maintain an appropriate comfort level for the person 50. The support mat 200 is mounted to the base panel 105 and maintained in position via a variety of straps. As further described in detail below, the straps retain the support mat 200 in position against the base panel 105 to allow for quick deployment of the rescue stretcher 100 and expedient loading of the person 50 onto the rescue stretcher 100 while maintaining the support mat 200 firmly secured.

With general reference to FIGS. 1-3, the rescue stretcher 100 includes a shoulder harness 205 including a first shoulder strap portion 210 and a second shoulder strap portion 215. The shoulder strap portions 210, 215 of the shoulder harness 205 may be fixedly attached to the support mat 200 along one end, and threaded through apertures on the base panel 105 along another end as further described below. For example, with particular reference to FIG. 1, an end of the first shoulder strap portion 210 may be sewn directly onto an underside (not shown) of a first flap 220 of the support mat 200. Similarly, an end of the second shoulder strap portion 215 may be sewn directly onto an underside (not shown) of a second flap 225 of the support mat 200. In this configuration, the shoulders strap portions 210, 215 are an integral component of the support mat 200 and remain attached thereto during deployment and use of the device. In addition, a segment of the first shoulder strap portion 210 may be threaded through an aperture 230 and a segment of the second shoulder strap portion 215 may be threaded through an aperture 235 on the base panel 105. Each of the first and second shoulder strap portions 210, 215 may include a loop handle 240, 245, respectively, formed on ends thereof. A carabiner 250 or other suitable connector may connect the two loop handles 240, 245 together adjacent the header end 110 of the base panel 105 to provide an attachment mechanism for a winch hook or other hauling device 425 for a vertical lift or descent rescue (see FIG. 7).

Figure 5:
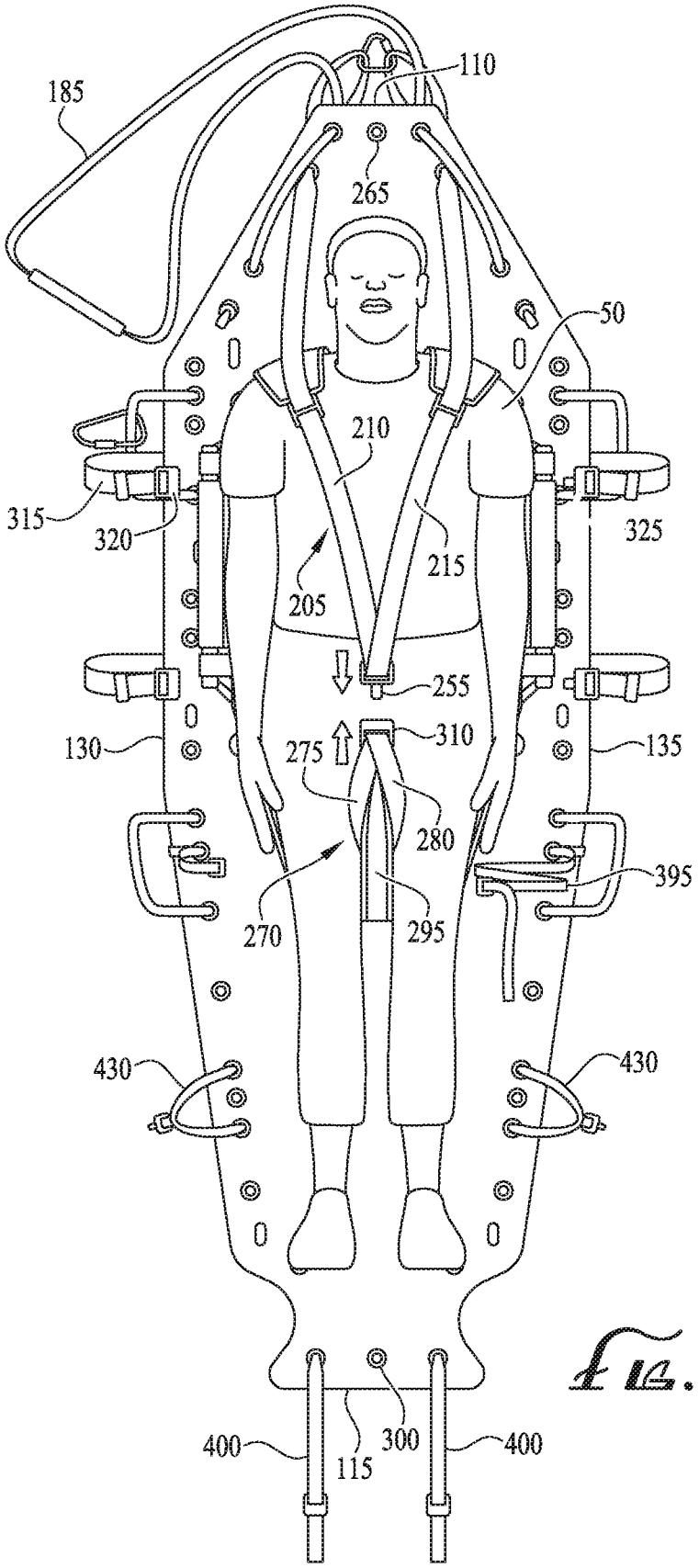
FIGS. 5-6 collectively illustrate a process for securing the injured person to the harness of the rescue stretcher of FIG. 1.

As best illustrated in FIG. 5, the first and second shoulder strap portions 210, 215 are preferably formed as one continuous looped segment, with a shoulder harness buckle part 255 attached thereto. As further described in detail below, the shoulder harness buckle part 255 attaches to a groin buckle part 310 to restrain the person 50 against the base panel 105.

As best seen in FIG. 2, the shoulder harness 205 further includes a release tab 260 that may be looped through a portion of the shoulder harness buckle part 255, and threaded through an eyelet 265 on the base panel 105. The release tab 260 preferably has a width sufficiently larger than the diameter of the eyelet 265 and with sufficient stiffness such that the release tab 260 remains coupled to the base panel 105 through the eyelet 265 prior to deployment of the rescue stretcher 100. As further described in detail below with reference to FIG. 5, when ready to deploy the rescue stretcher 100 to restrain a person 50, the release tab 260 may be pulled through the eyelet 265 to decouple the shoulder harness 205 from the base panel 105 and allow it to be positioned over the shoulders of the person 50.

With continued reference to FIG. 1, the support mat 200 further includes a groin harness 270 including a first groin strap 275 and a second groin strap 280. The groin straps 275, 280 may be fixedly attached to the support mat 200 along one end. For example, with particular reference to FIG. 1, an end of the groin strap 275 may be sewn directly onto an underside (not shown) of a third flap 285 of the support mat 200. Similarly, an end of the second groin strap 280 may be sewn directly onto an underside (not shown) of a second flap 290 of the support mat 200. The groin straps 275, 280 are preferably formed as one continuous looped segment, with a groin harness buckle part 310 attached thereto (see also FIG. 5). As mentioned previously, the groin harness buckle part 310 mates with the shoulder harness buckle part 255 to restrain the person 50 against the base panel 105.

The rescue stretcher 100 includes an elongate stability strap 295 stitched or otherwise fixedly coupled to lower ends of one or both of the groin straps 275, 280. The stability strap 295 generally extends along a central longitudinal axis of the rescue stretcher 100 from the groin straps 275, 280 toward an eyelet 300 formed along the footer end 115 of the base panel 105. The stability strap 295 includes a release tab 305 formed along an end thereof, the release tab 305 extending through the eyelet 300 to releasably couple the stability strap 295 to the base panel 105 (see FIG. 2). When the stability strap 295 is coupled to the base panel 105, the stability strap 295 helps stabilize the support mat 200 to help prevent the support mat 200 from slipping or otherwise sliding against the base panel 105 when a person 50 is being loaded onto the rescue stretcher 100. Similar to release tab 260 of the shoulder harness 205, the release tab 305 of the groin harness 270 preferably has a width sufficiently larger than the diameter of the eyelet 300 and with sufficient stiffness such that the release tab 305 remains coupled to the base panel 105 through the eyelet 300 prior to deployment of the rescue stretcher 100. As further detailed below, the release tab 305 may be pulled through the eyelet 300 to decouple the groin harness 270 from the base panel 105 and allow it to be positioned over the groin of the person 50.

With reference to FIGS. 1-3, the rescue stretcher 100 further includes a pair of securement straps 315 stretching transversely across base panel 105 and over person 50 for securing person 50 in rescue stretcher 100 when in use (see FIG. 6). Each securement strap 315 includes mating first and second buckle parts 320, 325 of a two-piece buckle system for securing person 50 on rescue stretcher 100. Preferably, a segment of the securement straps 315 is sewn or otherwise fixedly attached to the underside of the support mat 200 to retain the securement straps 315 in position. In some embodiments, the securement straps 315 may include one or more sleeves 330, where the sleeves 330 help retain a segment of the securement straps 315 prior to deployment for strap-management purposes. For example, the securement straps 315 may be folded over and inserted into the sleeve 330 to shorten the free portion of the securement strap 315 during transport. Once deployed, the securement straps 315 may be pulled out of the sleeve 330 and extended to its full length as needed. Additional details relating to deployment of the rescue stretcher 100 are provided below.

As illustrated in FIGS. 1 and 2, the securement straps 315 are coupled to the rescue stretcher 100 by weaving the straps through a variety of slits formed on the rescue stretcher 100. For example, with reference to FIGS. 1 and 2, a first portion of the securement strap 315 is threaded through a first exterior slit 335 formed adjacent the peripheral edge 135, and a second portion of the securement strap 315 is threaded through a second exterior slit 340 formed adjacent the peripheral edge 130 of the base panel 105 to secure the securement straps 315 to the base panel 105. When threaded through the slits 335, 340, the securement straps 315 extend from underneath the support mat 200, through the slits 335, 340, and beyond the peripheral edges 130, 135. When the securement straps 315 are fastened via the mating buckles 320, 325 and cinched tightly over the injured person 50, the securement straps 315 restrain the injured person 50 against the support mat 200 and the base panel 105, and also maintain the inwardly curved or rolled profile of the rescue stretcher 100 to further protect the injured person 50.

As mentioned previously, a portion of the securement straps 315 is preferably stitched or otherwise fixedly attached to a rear surface of the support mat 200 to keep both the support mat 200 and the securement straps 315 properly aligned and promote better securement of the person 50 in the rescue stretcher 100. In some embodiments, the rescue stretcher 100 may also include a support strap 345 that helps stabilize the support mat 200 against the base panel 105. The support strap 345 may be threaded through interior slits 450, 455 laterally offset from the exterior slits 335, 340 (used to couple the securement straps 315 to the base panel 105), respectively toward the center portion of the base panel 105. In some embodiments, the support strap 345 may also be threaded through the exterior slits 335, 340 and extend underneath the support mat 200. Preferably, the support strap 345 is sewn or otherwise fixedly attached to the securement straps 315 underneath the support mat 200 in a layered configuration, where the support strap 345 is sewn onto the securement strap 315, which is in turn sewn to the support mat 200.

With reference to FIG. 1, the rescue stretcher 100 further includes a pair of lift sling straps 350, 355, each sling strap 350 stretching transversely across the base panel 105, with a large portion of the sling straps 350, 355 positioned directly underneath the support mat 200. The sling straps 350, 355 are preferably each a single strap of reinforced webbing material, but may be formed as segmented pieces of material in other embodiments. In some embodiments, the sling straps 350, 355 are weaved into webbing attached to the underside of the support mat 200 to retain the sling straps 350, 355 in proper position for deployment. In other embodiments, the sling straps 350, 355 may be sewn or otherwise affixed to the underside of the support mat 200. The sling straps 350, 355 each further include loop handles 360 formed on either end of the respective straps 350, 355 to aid in an horizontal lift or descent as further described in detail below (see also FIG. 9).

With reference to FIG. 1, the support mat 200 includes a pair of sling pouches 365, 370 formed on lateral sides of the support mat 200. To avoid confusion and repetitive description, the following discussion focuses on the features of sling pouch 365 with the understanding that the features of sling pouch 365 apply to sling pouch 370. The sling pouch 365 includes a first flap 375 and a second flap 380, the flaps 375, 380 being removably securable to one another via any one of a number of suitable mechanisms. For example, in one embodiment, the sling pouch 365 may include a hook-and-loop fastener. In one such embodiment, the first flap 375 may include a hook portion 385 affixed thereto, and the second flap 380 may include a loop portion 390 affixed thereto (or vice versa). When the flaps 375, 380 are secured to one another, an opening or cavity is formed therebetween. As illustrated in FIG. 1, the cavity between the flaps 375, 380 may be used to house the loop handles 360 on the corresponding ends of lift sling straps 350, 355 to help maintain the various straps of the rescue stretcher 100 neatly stowed until needed. As further explained in detail below, the loop handles 360 of the lift sling straps 350, 355 may be quickly deployed by pulling them from the sling pouches 365, 370 as needed.

Preferably, the shoulder harness 205, groin harness 270, stability strap 295, securement straps 315, and lift sling straps 350, 355 are each individually made of a single, continuous elongate strip of sturdy fabric, such as woven nylon webbing, although, other reinforced materials may also be suitable. In other embodiments, the straps may not be continuous and may instead comprise multiple segments of material. In addition, various buckle types may be used for two-piece buckle, such as a three-way buckle, double bar buckle, swivel bar buckle, or others. Preferably, the buckle parts described above are each constructed from strong materials, such as metals, but may otherwise be constructed from other suitable materials.

FIGS. 4-7 collectively illustrate a deployment process of the rescue stretcher 100 to secure the person for a vertical lift or descent extraction in accordance to one embodiment. With general reference to FIGS. 1-7, the following description relates to an example deployment operation of the rescue stretcher 100. Prior to operation, the rescue stretcher 100 is buckled via the foot end straps 400 in a rolled-up configuration. In this configuration, the rescue stretcher 100 may be easily carried to a position where injured person 50 is located. At the site, the rescue stretcher 100 is unbuckled, unrolled and laid flat on the ground next to the person 50, with the rear of the base panel 105 contacting the ground. In some embodiments, the header and/or footer ends 110, 115 may need to be bent backward by the rescue personnel to reverse roll the header and/or footer ends 110, 115 and allow the base panel 105 to lay flat. As illustrated in FIG. 1, when the rescue stretcher 100 is unrolled and laid flat, the shoulder harness 205 and elongate stability strap 295 retain the support mat 200 in position generally centered on the front surface 120 of the base panel 105. Once the base panel 105 is flat on the ground, cross strap 395 is unbuckled and moved away from the support mat 200. In some embodiments, prior to loading the person 50, the footer end 115 may be rolled/curled downwardly to form a ramp and to prevent snagging of the patient's clothing during the loading process.

With the base panel 105 flat on the ground, the person 50 is dragged onto the base panel 105 and the support mat 200. To help prevent lateral movement of the patient's head and minimize further injury, rescue personnel may grasp the underarms of the person 50 to drag the person 50 onto the base panel 105 until the person's head is centered between the flaps 220, 225 of the support mat 200. With reference to FIG. 4, the person 50 is generally aligned along a central longitudinal axis of the rescue stretcher 100, with the upper torso region resting on the support mat 200, and the lower body contacting the front surface 120 of the base panel 105.

Once the person 50 is properly positioned on the base panel 105 and support mat 200, person 50 is restrained on rescue stretcher 100 using a variety of harnesses and straps. With general reference to FIGS. 2 and 5, the shoulder harness 205 is decoupled from the base panel 105 and released by pulling on the release tab 260 to free it from the eyelet 265 (see FIG. 2). Once the release tab 260 is pulled through the eyelet 265, the shoulder harness 205 is moved over the person's shoulders and toward the mid-section, thereby positioning the first and second shoulder strap portions 210, 215 across the shoulders of the person 50 (see FIG. 5). In some embodiments, the shoulder strap portions 210, 215 may be cinched by adjusting an adjustment strap segment (not shown) of the shoulder strap portions 210, 215. When the shoulder harness 205 is in position, the shoulder harness buckle part 255 is exposed around the mid-section of the person 50 and is ready for mating with the groin harness 270 as described below.

Once the shoulder harness 205 has been adjusted to suit the person 50, the groin harness 270 is decoupled from the base panel 105 and released by pulling on the release tab 305 to free it from the eyelet 300. Once released, the groin harness 270 is moved toward the shoulder harness 205 to mate the corresponding buckle parts 255, 310 near the mid-section of the person 50 (see FIG. 5). The groin straps 275, 280 may be adjusted to pull the flaps 285, 290 securely against the person's legs. If needed, the shoulder harness 205 may be adjusted once more to ensure the person 50 is securely restrained against the base panel 105.

With reference to FIG. 6, once the shoulder harness 205 and the groin harness 270 are tightened and secured, the securement straps 315 are released from the sleeves 330 by pulling outwardly and ready for deployment. In some embodiments, the sleeves 330 may be color-coded for convenience and quick deployment. The straps 315 are stretched transversely across person 50, secured via the mating buckle parts 320, 325, and cinched as necessary to secure the person 50. When straps 315 are cinched, left and right peripheral edges 130, 135 of base panel 105 roll inwardly toward one another so that base panel 105 cradles and better supports person 50. To further support the rolled configuration in the lower third portion of the rescue stretcher 100, the rescue stretcher 100 includes a cross strap 395 that extends transversely across the base panel 105. Once the cross strap 395 is fastened, the left and right peripheral edges 130, 135 of the base panel 105 curl inwardly in a similar fashion as described above.

Finally, after the cross strap 395 is fastened, the foot side straps 430 on the left and right peripheral edges 130, 135 may be fastened and cinched to pull the footer end 115 inwardly and create a foot rest section. The foot end straps 400 may be cinched as needed to allow the person's feet to rest against the curled footer end 115 and help prevent downward sliding movement of the person 50.

In the described configuration, the securement straps 315 support person 50 and hold the rescue stretcher 100 in a rolled configuration to help resist movement of the person 50 toward the left and right peripheral edges 130, 135 of base panel 105. In addition, the shoulder harness 205 arrests the shoulder and resists sliding movement of the person 50 toward header end 110, while the groin harness 270 supports the legs and resists movement of the person 50 toward the footer end 115. Once the person 50 is secured on rescue stretcher 100, rescue personnel can carry person 50 using the plurality of loop handles 180 or pull person 50 using drag strap 185 as necessary. In some operations, person 50 may be extracted using a combination of dragging and/or carrying techniques. For example, person 50 may be carried over some obstacles that are harder to maneuver around and dragged through narrow areas or in situations where only one rescuer is available.

In still other rescue operations, a winch or haul device (not shown) may be necessary to lift the packaged person 50 from the rescue site. In such operations, the drag strap 185 may be pulled over the patient and knotted around or otherwise secured to the securement strap 315 adjacent the groin harness 270. This action curls the header end 110 upwardly over the patient's head. Thereafter, the carabiner 250 connecting the two loop handles 240, 245 of the shoulder harness 205 may be fastened to the winch or haul device 425 for evacuation (see FIG. 7).

Figure 8:
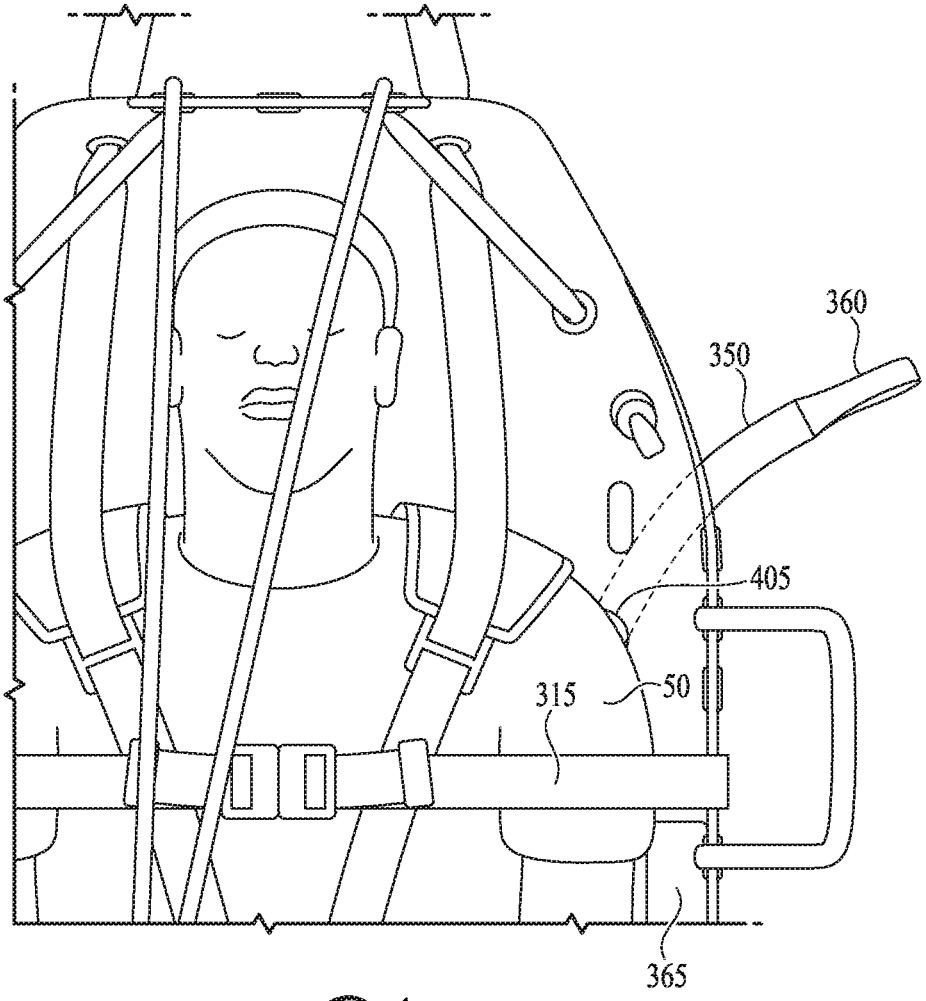
FIGS. 8-10 collectively illustrate a process for preparing the secured person for a horizontal lift or descent extraction.
Figure 9:
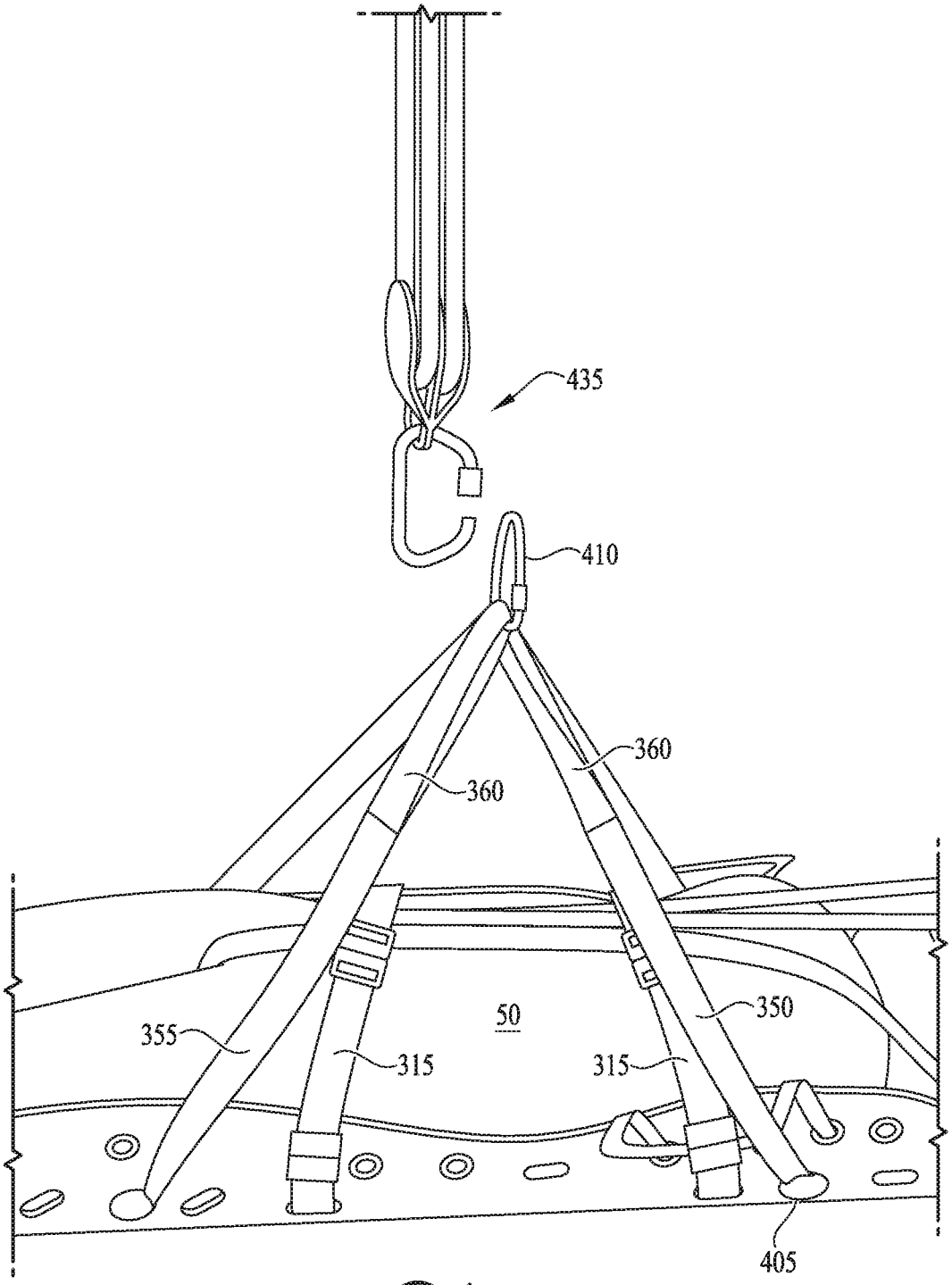
Figure 10:
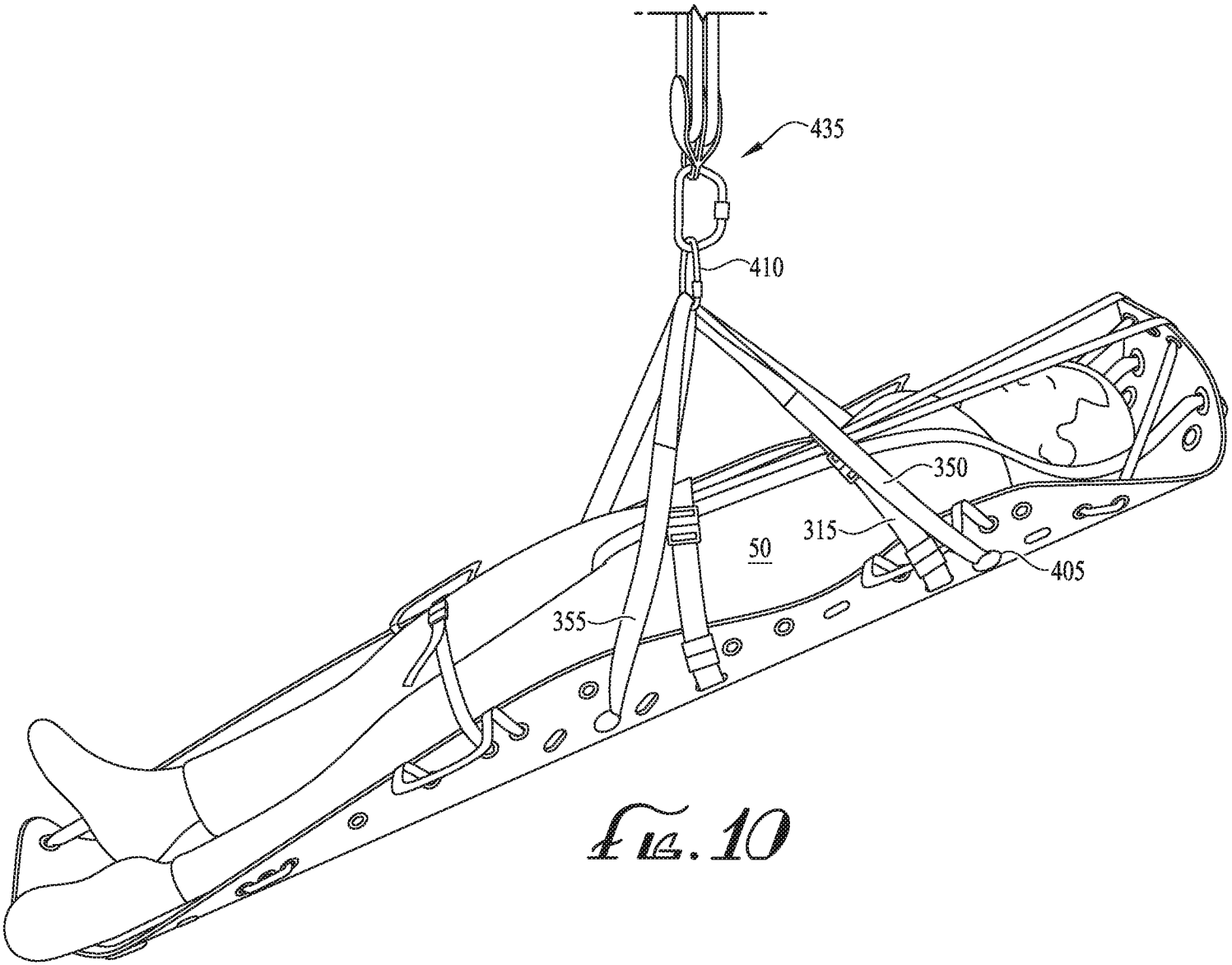

FIGS. 8-10 illustrate additional details of the rescue stretcher 100 involving use for a horizontal lift or descent extraction. For this type of rescue operation, the person 50 is secured to the rescue stretcher 100 in the same or similar fashion as described previously with reference to FIGS. 1-7. Accordingly, this discussion focuses on additional features of the rescue stretcher 100 for horizontal lift and descent extractions. Once the person 50 is secured to the rescue stretcher 100, the sling straps 350, 355 are released from the sling pouches 365, 370. For example, with reference to FIG. 8, the loop handle 360 of the sling strap 350 is removed from the sling pouch 365 and weaved through an opening 405 formed on the base panel 105 (see also FIG. 2) adjacent the shoulder area of the person 50. Preferably, the opening 405 is larger than the eyelet openings and is substantially round to optimize weight distribution and avoid concentrating stresses that may damage the base panel 105 when the person 50 is lifted for evacuation. The loop handle 360 is inserted through the opening 405 and pulled underneath the base panel 105. The same process is repeated for the remaining loop handles 360 of the sling straps 350, 355. Once the four loop handles 360 have been weaved through the base panel 105, the loop handles 360 are equalized over the person 50 and secured together via a carabiner 410 or other suitable connector device as illustrated in FIG. 9. The carabiner 410 in turn is connected to a winch hook or haul line 435 for extraction. As illustrated in FIG. 10, when the rescue stretcher 100 is hoisted, the rescue stretcher 100 automatically adjusts with a slight head up position to maximize patient comfort.

Figure 11:
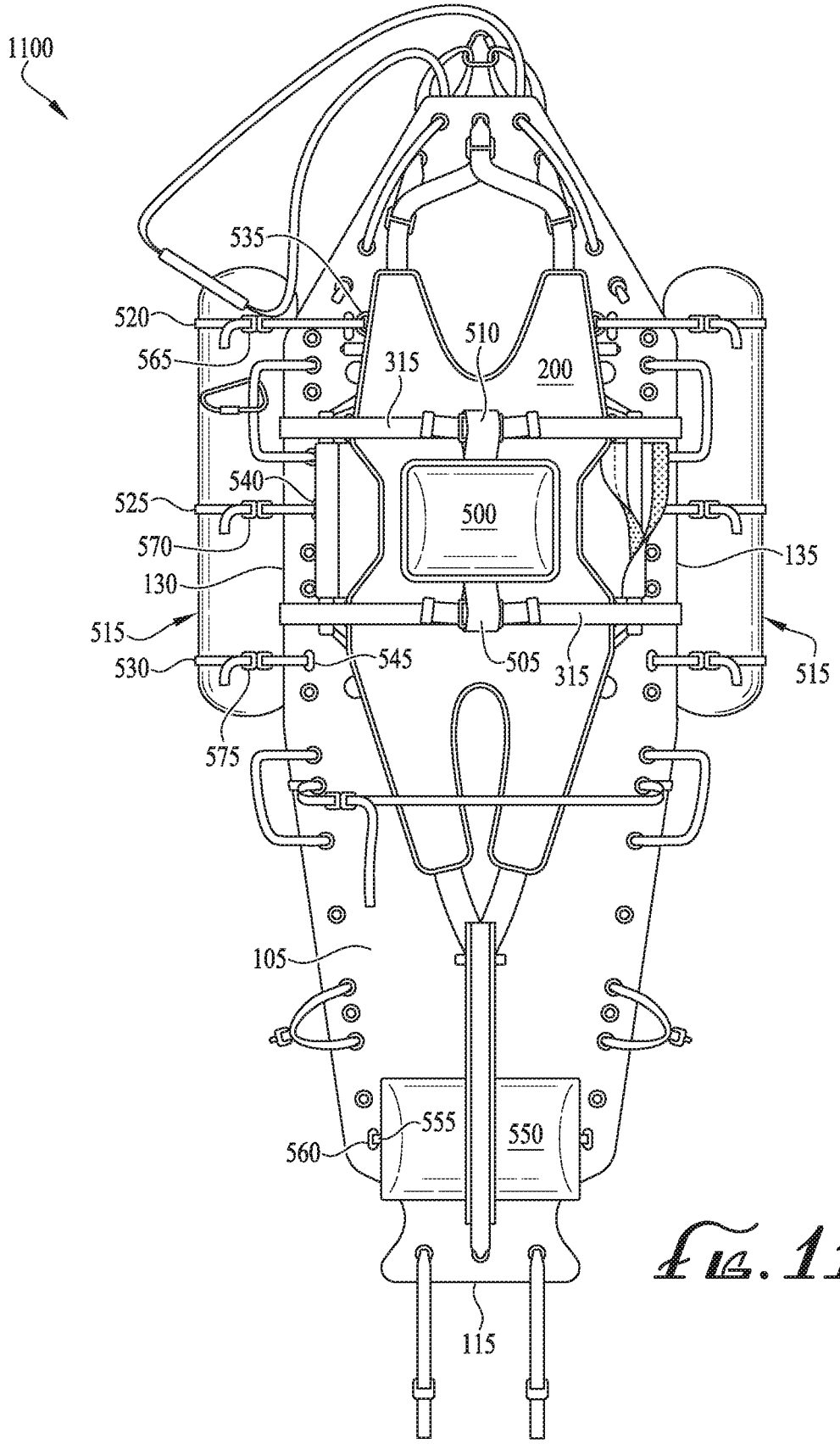
FIG. 11 illustrates a top view of a rescue stretcher in accordance with another embodiment, the rescue stretcher having flotation devices for a water evacuation.

FIG. 11 illustrates a top view of a rescue stretcher 1100 in a flat configuration, the rescue stretcher 1100 including one or more flotation devices, 500, 515, 550 attached thereto to facilitate water extractions using the rescue stretcher 1100. The rescue stretcher 1100 may include the same or substantially similar features as described previously with reference to FIGS. 1-10. Accordingly, such features of the rescue stretcher 1100 may not be numbered in FIG. 11 and are not further described with reference to the embodiment illustrated in FIG. 11 to avoid repetition and/or obscuring more pertinent aspects of the embodiment. However, it should be understood that the rescue stretcher 1100 may nevertheless include all or a subset of the features described with respect to the rescue stretcher 100 even though such features are not further illustrated or described with reference to the rescue stretcher 1100. With general reference to FIG. 11, the following provides additional details specifically relating to the various flotation devices 500, 515, 550 of the rescue stretcher 1100.

With reference to FIG. 11, the rescue stretcher 1100 includes a chest flotation device 500 for assisting with a water evacuation scenario. The chest flotation device 500 may comprise any suitable buoyant material, and may or may not require inflation to activate. In embodiments requiring inflation, the flotation device 500 may be inflated in any suitable manner, such as by self-contained carbon dioxide cartridges activated by pulling a cord (i.e., in a similar fashion as a life-jacket) or by using blow tubes with a one-way valve for oral inflation (i.e., by blowing air into the valve). The chest flotation device 500 may include a pair of loop handles 505, 510 that are sewn into, or otherwise fixedly coupled, to top and bottom edges of the chest flotation 500. When ready for deployment, the chest flotation device 500 may be placed onto the chest of the injured person 50 and secured in position by inserting the securement straps 315 through the respective loop handles 505, 510 of the flotation device 500 and thereafter buckling the person 50 to the rescue stretcher 1100. When the securement straps 315 are buckled and cinched, the injured person 50 is secured to the rescue stretcher 1100, and the chest flotation device 500 is secured over the chest of the person 50.

The rescue stretcher 1100 further includes a pair of flotation logs 515 arranged adjacent the peripheral edges 130, 135 of the rescue stretcher 1100 to provide improved stability and additional buoyancy to the rescue stretcher 1100 when the person 50 is secured thereto. Similar to the chest flotation device 500, the flotation logs 515 may comprise any suitable buoyant material and may or may not require inflation to activate. In embodiments requiring inflation, the flotation logs 515 may be inflated in a similar manner as described previously with respect to the chest flotation device 500. The flotation logs 515 each include a plurality of securement strap 520, 525, 530 for securing the flotation logs 515 to the rescue stretcher. In one arrangement, the first securement strap 520 may include a buckle attachment 565 to secure the securement strap 520 through a retaining loop 535 that is fixed to the support mat 200. The second and third straps 525, 530 may each extend through a slit 540, 545 formed on the base panel 105 of the rescue stretcher 1100 to secure the flotation logs 515 to the rescue stretcher 1100. The securement straps 525, 530 may each also include buckle attachments 570, 575 for securing and cinching the straps 525, 530 as needed.

In some embodiments, the rescue stretcher 1100 may further include a ballast bag 550 arranged adjacent the footer end 115 of the rescue stretcher 1100 to improve buoyancy and stability of the rescue stretcher 1100 adjacent the feet of the person 50. The ballast bag 550 may comprise any suitable buoyant material and may or may not require inflation as described previously with reference to the chest flotation device 500 and flotation logs 515. To secure the ballast bag 550 to the rescue stretcher 1100, a securement strap 555 of the ballast bag 550 is extended through a pair of slits 560 formed on the base panel 105 of the rescue stretcher 1100. In some embodiments, the securement strap 555 may include hook and loop fastener means to accommodate coupling of the straps 555 together and secure the ballast bag 550. In other embodiments, the securement strap 555 may include other fastening means, such as clips, buckles, or other attachment means.

Preferably, the flotation devices 500, 515, 550 are standalone components that may be easily coupled to and removed from the rescue stretcher 1100 as needed. For example, in some embodiments, the flotation devices 500, 515, 550 may be stored in bags or compartments separate from the rolled-up rescue stretcher 1100 to minimize bulk of the rescue stretcher 1100 itself. Since the flotation devices 500, 515, 550 are primarily useful during water extractions and may create an obstacle or additional hindrance during other extraction procedures (e.g., during dragging evacuations or airlift evacuations), storing the flotation devices 500, 515, 550 separately may be best. Accordingly, the flotation devices 500, 515, 550 may be deployed only when needed, such as during water evacuations, and coupled to the rescue stretcher 1100 as described, but are otherwise separated from the rescue stretcher 1100 when not in use to optimize the utility of the rescue stretcher 1100.

Figure 12:
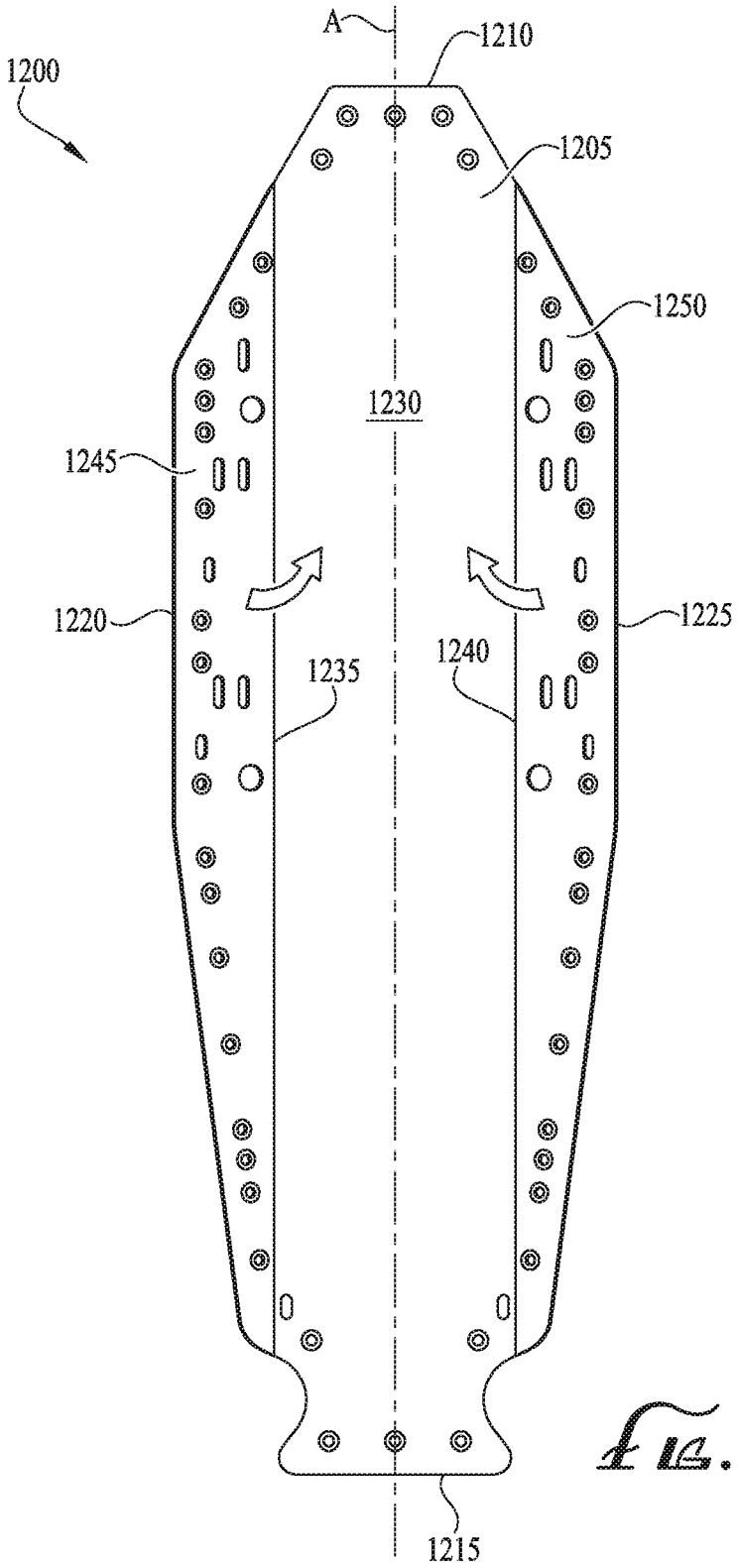
FIGS. 12-13 illustrate views of a rescue stretcher in accordance with yet another embodiment, where the base panel includes scored foldable portions to facilitate a rolling and packaging process of the rescue stretcher.
Figure 13:
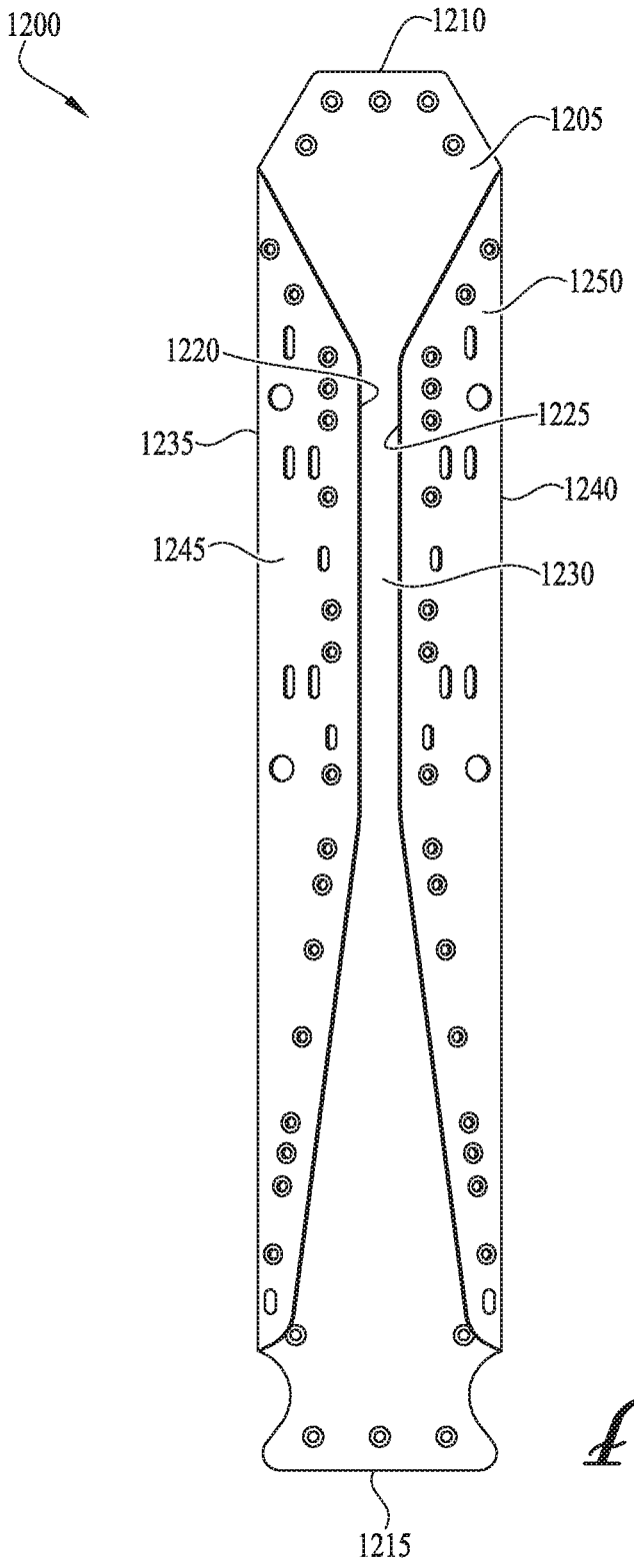

FIGS. 12-13 collectively illustrate views of a rescue stretcher 1200 in a flat configuration, the rescue stretcher 1200 including scored foldable portions to create a pair of flaps 1245, 1250 for facilitating packaging of the rescue stretcher 1200 in a rolled-up configuration for deployment and/or storage. The rescue stretcher 1200 may include the same or substantially similar features as described previously with reference to the rescue stretcher 100 described and illustrated with reference to FIGS. 1-10. Accordingly, such features of the rescue stretcher 1200 may not be numbered in FIGS. 12-13 and are not further described with reference to the embodiments illustrated in these figures to avoid repetition and/or obscuring more pertinent aspects of the embodiment. However, it should be understood that the rescue stretcher 1200 may nevertheless include all or a subset of the features described with respect to the rescue stretcher 100 even though such features are not further illustrated or described with reference to the rescue stretcher 1200.

With reference to FIGS. 12-13, the rescue stretcher 1200 includes an elongated, flexible base panel 1205 panel having a plurality of eyelets and slits (not numbered) arranged in a similar fashion as described previously with reference to the rescue stretcher 100. Base panel 1205 includes a header end 1210 and a footer end 1215 opposite header end 1210, and further includes opposite left and right peripheral edges 1220, 1225 horizontally offset from one another. The base panel 1205 includes a generally central, body-supporting region 1230 for an injured person, the body-supporting region 1230 defined or bounded between the header and footer ends 1210, 1215 and the peripheral edges 1220, 1225 of the base panel 1205.

With particular reference to FIG. 12, the base panel 1205 includes a first crease 1235 and a second crease 1240 formed thereon, the creases 1235, 1240 being arranged generally parallel to a vertical axis A extending through the base panel 1205 from the header end 1210 through the body-supporting region 1230 and to the footer end 1215. In one embodiment, the creases 1235, 1240 may each extend from an upper region of the base panel 1205 adjacent the header end 1210 toward a lower region of the base panel 1205 adjacent the footer end 1215 as illustrated in FIG. 12. In another embodiment, the creases 1235, 1240 may extend directly from the upper edge of the base panel 1205 at the header end 1210 to the lower edge of the base panel 1215 at the footer end 1215. In other embodiments, the crease lines 1235, 1240 may extend along any one of various suitable points adjacent the header and footer ends 1210, 1215 of the base panel 12105 as would be understood by one having ordinary skill in the art.

The crease 1235 extending vertically along the base panel 1205 defines a first flap 1245 of the base panel 1205, the first flap 1245 including a plurality of slits and eyelets formed along the peripheral edge 1220 of the base panel 1205 as illustrated in FIG. 12. Similarly, the crease 1240 extending vertically along the base panel 1205 defines a second flap 1250 of the base panel 1205, the second flap 1250 including a plurality of slits and eyelets formed along the peripheral edge 1225 of the base panel 1205. As further described in detail with reference to FIG. 13, the flaps 1245, 1250 are each foldable inwardly along the respective creases 1235, 1240 toward the body-supporting region 1230 of the base panel 1205 to reduce or minimize the width of the base panel 1205 prior to rolling and storing the rescue stretcher 1200.

With reference to FIG. 13, the rescue stretcher 1200 is illustrated with its flaps 1245, 1250 folded inwardly toward the body-supporting region 1230. As illustrated, the width of the rescue stretcher 1200 is substantially less than the respective width of the rescue stretcher 1200 in its unfolded configuration. It should be understood that while the flaps 1245, 1250 are described as folding inwardly toward the body-supporting region 1230 on a top surface of the rescue stretcher 1200, the flaps 1245, 1250 may instead be folded underneath the body-supporting region 1230, if desired.

The following description relates to methods for quickly and efficiently rolling and packaging the rescue stretchers 100, 1100, 1200 for subsequent deployment after an extraction process is completed. With general reference to FIGS. 1-3, the following discussion provides additional details regarding the rolling and packaging process. Once the person 50 has been removed from the rescue stretcher 100, the lift slings 350, 355 may be released from the carabiner 410 and pulled back through the openings 405 of the base panel 105. Thereafter, the sling pouches 365, 370 may be opened, such as by uncoupling the flaps 375, 380. With the sling pouches 365, 370 opened, the loop handles 360 of the lift slings 350, 355 are folded into the sling pouches 365, 370. Thereafter, the sling pouches 365, 370 are closed to retain the loop handles 360.

Thereafter, the securement straps 315 are straightened out and stretched across the support mat 200. The webbing of the securement straps 315 is pulled through the slits 335, 340 until the buckle parts 320, 325 are adjacent the left and right peripheral edges 130, 135 of the base panel 105, and the excess webbing is secured via the sleeve 330 to manage the straps (see FIG. 1).

Next, the shoulder harness 205 is extended over the support mat 200 to expose the release tab 260. The release tab 260 is pulled through the eyelet 265 and secured, thereby restraining the harness 205 in position against the base panel 105. If needed, the first and second shoulder strap portions 210, 215 may be adjusted and the excess webbing pulled through a sleeve (not shown) for storage. Thereafter, the stability strap 295 of the groin harness 270 is extended and the release tab 305 is pulled through the eyelet 300 to secure the groin harness 270 against the base panel 105. Finally, the cross strap 395 is extended across the rescue stretcher 100 and buckled.

To roll the rescue stretcher 100, the rescue stretcher 100 is first laid flat with all harnesses and straps secured as described previously. Thereafter, the drag handle 185 is initially moved aside and the header end 110 is curled inwardly. To keep the rescue stretcher 100 tightly rolled and small, the rescue personnel may need to apply pressure using one or both knees. The drag handle 185 may be returned and the rescue stretcher 100 is continually rolled all the way to the footer end 115, while ensuring that the foot end straps 400 remain exposed along the left and right peripheral edges 130, 135 and along the footer end 115. Once the rescue stretcher 100 has been entirely rolled, the foot end straps 400 may be fastened to one another to retain the rescue stretcher 100 in a rolled configuration and ready for deployment.

In the embodiment illustrated in FIGS. 12-13, the rolling and packaging process may be similar as described above, but with an additional step completed prior to rolling. Once the straps and harnesses are reset in the same fashion as described above, the flaps 1245, 1250 are folded inwardly toward the body-supporting region 1230 to reduce the width of the rescue stretcher 1200. Thereafter, the base panel 1205 may be rolled and secured in the same fashion described above and ready for redeployment as needed.

It should be understood that many of the components and arrangements described in the embodiments of FIGS. 1-13 are for illustration purposes. Accordingly, one having ordinary skill in the art may rearrange the components of the embodiments described herein without departing from the principles of the disclosure.

In addition, it is intended that subject matter disclosed in portion herein can be combined with the subject matter of one or more of other portions herein as long as such combinations are not mutually exclusive or inoperable. In addition, many variations, enhancements and modifications of the rescue stretcher concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A stretcher comprising:

an elongate, flexible panel sized to underlay a person laying thereon, the panel including a front surface and an opposite rear surface, a header end and an opposite footer end, and a first side and an opposite second side, the panel further including a first opening extending through the panel;

a support mat including a top surface for receiving the person and an opposite rear surface resting against the front surface of the flexible panel;

a shoulder harness fixedly coupled to the support mat; and a groin harness fixedly coupled to the support mat, the groin harness including a first release tab extending through the first opening of the flexible panel to releasably couple the groin harness to the flexible panel, wherein the first release tab is releasable from the flexible panel, the groin harness and shoulder harness configured to restrain the person against the support mat and flexible panel for transport.

2. The stretcher of claim 1, wherein the shoulder harness includes a first buckle and the groin harness includes a second buckle, the first and second buckles configured to mate with one another to restrain the person against the support mat and flexible panel for transport.

3. The stretcher of claim 1, wherein the support mat further includes a first sling pouch with a first cavity formed therein and a second sling pouch with a second cavity formed therein, the stretcher further comprising a first lift sling strap configured for lifting the flexible panel during transport, the first lift sling strap including a loop handle formed on opposite ends thereof, wherein one of the loop handles is housed within the cavity of the first sling pouch and the other of the loop handles is housed within the cavity of the second sling pouch when in a stowed configuration.

4. The stretcher of claim 3, the stretcher further comprising a second lift sling strap configured for lifting the flexible panel during transport, the second lift sling strap including a loop handle formed on opposite ends thereof, wherein the first lift sling strap extends through a first pair of openings formed on the flexible panel and the second lift sling extends through a second pair of openings formed on the flexible panel, and wherein the loop handles of the first lift sling strap and the loop handles of the second lift sling strap are configured to couple to one another via a connector for lifting the flexible panel during transport.

5. The stretcher of claim 1, wherein the groin harness further includes a stability strap, and wherein the first release tab of the groin harness is formed at an end of the stability strap, the first release tab having a width larger than a diameter of the first opening and wherein the first release tab extends through the first opening of the flexible panel and is seated against the rear surface of the flexible panel when the stability strap is coupled to the flexible panel, the stability strap operable to retain the support mat in position against the flexible panel.

6. The stretcher of claim 1, further comprising:

a first securement strap fixedly coupled to the support mat, the first securement strap including a first segment with a first strap buckle and a second segment with a second strap buckle, wherein the first securement strap extends transversely across the flexible panel from the first side to the second side thereof when the first and second strap buckles mate with one another; and a second securement strap fixedly coupled to the support mat, the second securement strap including a first segment with a first strap buckle and a second segment with a second strap buckle, wherein the second securement strap extends transversely across the flexible panel from the first side to the second side thereof when the first and second strap buckles mate with one another.

7. The stretcher of claim 6, wherein the first securement strap extends across the shoulder harness when buckled, and the second securement strap extends across the groin harness when buckled.

8. The stretcher of claim 1, wherein the shoulder harness further includes a first portion releasably coupled to the flexible panel via a second opening formed on the flexible panel, the first portion being releasable relative to the flexible panel.

9. The stretcher of claim 1, the shoulder harness further including a first loop handle and a second loop handle spaced apart from one another, the stretcher further comprising a connector operable to couple the first and second loop handles of the shoulder harness to provide an attachment point for transporting the flexible panel.

10. The stretcher of claim 1, further comprising:

a first crease formed along the flexible panel, the first crease defining a first flap including the first side of the flexible panel; and a second crease formed along the flexible panel, the second crease defining a second flap including the second side of the flexible panel, wherein the first flap and the second flap are each foldable along the first and second creases, respectively, to position the first and second flaps over the support mat.

11. The stretcher of claim 1, further comprising one or more flotation devices releasably coupled to the flexible panel to improve the buoyancy of the flexible panel.

12. The stretcher of claim 11, wherein the one or more flotation devices each includes one or more securement straps, the one or more securement straps attachable to the flexible panel via one or more apertures formed thereon for securing the flotation device to the flexible panel.

13. The stretcher of claim 11, the stretcher further comprising a first securement strap fixedly coupled to the support mat, the first securement strap including a first segment with a first strap buckle and a second segment with a second strap buckle, wherein the first securement strap extends transversely across the flexible panel from the first side to the second side thereof when the first and second strap buckles mate with one another, and the one or more flotation devices each include a loop handle formed thereon, wherein the first securement strap extends through the loop handle of the one or more flotation devices to retain the one or more flotation devices in position.

14. The stretcher of claim 8, wherein the shoulder harness includes a third portion extending through a third opening formed on the flexible panel, and a fourth portion extending through a fourth opening formed on the flexible panel, the third and fourth portion each including a loop handle formed on an end thereof.

15. The stretcher of claim 8, wherein the first portion of the shoulder harness comprises a second release tab having a width larger than a diameter of the second opening, and wherein the second release tab extends through the second opening of the flexible panel and is seated against the rear surface of the flexible panel when the shoulder harness is coupled to the flexible panel.

16. The stretcher of claim 15, wherein the groin harness further includes a stability strap, and wherein the first release tab of the groin harness is formed at an end of the stability strap, the first release tab having a width larger than a diameter of the first opening, and wherein the first release tab extends through the first opening of the flexible panel and is seated against the rear surface of the flexible panel when the stability strap is coupled to the flexible panel, the stability strap operable to retain the support mat in position against the flexible panel.

17. A stretcher comprising:

an elongate, flexible panel sized to underlay a person laying thereon, the panel including a header end and an opposite footer end, a first side and an opposite second side, the panel further including a first opening extending through the panel;

a support mat including a top surface for receiving the person and an opposite rear surface resting against the flexible panel;

a shoulder harness coupled to the support mat;

a groin harness coupled to the support mat, the groin harness including a release tab extending through the first opening of the flexible panel to releasably couple the groin harness to the flexible panel, wherein the release tab of the groin harness is releasable from the flexible panel, the groin harness and shoulder harness configured to restrain the person against the support mat and flexible panel for transport;

a first securement strap fixedly coupled to the support mat, the first securement strap including a first segment with a first strap buckle and a second segment with a second strap buckle, wherein the first securement strap extends transversely across the flexible panel from the first side to the second side thereof when the first and second strap buckles mate with one another, and wherein the first securement strap extends across the shoulder harness when buckled; and a second securement strap fixedly coupled to the support mat, the second securement strap including a first segment with a first strap buckle and a second segment with a second strap buckle, wherein the second securement strap extends transversely across the flexible panel from the first side to the second side thereof when the first and second strap buckles mate with one another, and wherein the second securement strap extends across the groin harness when buckled.

18. The stretcher of claim 17, wherein the flexible panel includes a front surface and an opposite rear surface, and wherein the first opening extends through the flexible panel from the front surface to the rear surface, and wherein the release tab of the groin harness extends through the first opening of the flexible panel and is seated against the rear surface of the flexible panel when the groin harness is coupled to the flexible panel.

19. A stretcher comprising:

an elongate, flexible panel sized to underlay a person laying thereon, the panel including a header end and an opposite footer end, a first side and an opposite second side, the panel further including a first opening, a second opening, a third opening, and a fourth opening each extending through the panel;

a support mat including a top surface for receiving the person and an opposite rear surface resting against the flexible panel;

a shoulder harness including a first portion coupled to the support mat, wherein the shoulder harness further includes a second portion releasably coupled to the flexible panel via the first opening, the second portion being releasable from the flexible panel, and wherein the shoulder harness includes a third portion extending through the second opening formed on the flexible panel, and a fourth portion extending through the third opening formed on the flexible panel, the third and fourth portions each including a loop handle formed on an end thereof; and a groin harness including a first portion coupled to the support mat and a second portion releasably coupled to the flexible panel via the fourth opening, wherein the second portion of the groin harness is releasable from the flexible panel, the groin harness and shoulder harness configured to restrain the person against the support mat and flexible panel for transport.

20. The stretcher of claim 19, further comprising:

a first securement strap fixedly coupled to the support mat, the first securement strap including a first segment with a first strap buckle and a second segment with a second strap buckle, wherein the first securement strap extends transversely across the flexible panel from the first side to the second side thereof when the first and second strap buckles mate with one another, and wherein the first securement strap extends across the shoulder harness when buckled; and a second securement strap fixedly coupled to the support mat, the second securement strap including a first segment with a first strap buckle and a second segment with a second strap buckle, wherein the second securement strap extends transversely across the flexible panel from the first side to the second side thereof when the first and second strap buckles mate with one another, and wherein the second securement strap extends across the groin harness when buckled.

* * * * *